US006588964B1

(12) United States Patent
Au et al.

(10) Patent No.: US 6,588,964 B1
(45) Date of Patent: Jul. 8, 2003

(54) FLUID APPLICATOR

(75) Inventors: Bob Wayne Au, Mason, OH (US); Anne Marie Candido, Mason, OH (US); Philip Davies, Surrey (GB); Mark Thomas Lund, West Chester, OH (US); Charles William Sears, Boxford, MA (US); Marc Walter Tanner, London (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/685,777

(22) Filed: Oct. 10, 2000

(51) Int. Cl.[7] ..... A46B 11/04

(52) U.S. Cl. ..... 401/282; 401/188 R; 401/28; 401/270; 132/113; 132/114

(58) Field of Search ..... 401/282, 270, 401/275, 278, 279, 188 R, 189, 190, 28; 132/113, 114, 219

(56) References Cited

U.S. PATENT DOCUMENTS

| | | | | | |
|---|---|---|---|---|---|
| 1,435,911 | A | | 11/1922 | Bechtold | |
| 2,265,972 | A | * | 12/1941 | Pearson | 132/114 |
| 2,478,648 | A | | 8/1949 | Wheeler | |
| 2,624,348 | A | | 9/1953 | Matson | |
| 2,794,443 | A | * | 6/1957 | Moore | 132/113 |
| 3,312,583 | A | | 4/1967 | Rochlis | |
| 3,463,170 | A | * | 8/1969 | McCullough | 132/113 |
| 3,950,532 | A | | 4/1976 | Bouillon et al. | 424/275 |
| 3,961,635 | A | * | 6/1976 | Miya | 132/113 |
| 4,170,229 | A | | 10/1979 | Olson | 128/67 |
| 4,185,099 | A | | 1/1980 | Sorbini | 424/238 |
| 4,237,822 | A | * | 12/1980 | Kaiser, Jr. | 401/181 |
| 4,316,887 | A | | 2/1982 | Kamishita et al. | 424/81 |
| 4,720,046 | A | | 1/1988 | Morane | |
| 4,728,667 | A | | 3/1988 | Yanagi et al. | |
| 4,834,076 | A | | 5/1989 | Millet et al. | 128/65 |
| 4,913,172 | A | * | 4/1990 | Chou | 132/113 |
| 4,940,578 | A | | 7/1990 | Yoshihara et al. | 424/70 |
| 5,002,075 | A | | 3/1991 | Kellett et al. | 132/108 |
| 5,054,504 | A | * | 10/1991 | Winrow | 132/114 |
| 5,297,882 | A | * | 3/1994 | Kornides | 401/184 |
| 5,523,078 | A | | 6/1996 | Baylin | 424/70.1 |
| 5,975,089 | A | * | 11/1999 | Simon | 132/113 |

FOREIGN PATENT DOCUMENTS

| | | | |
|---|---|---|---|
| CA | 959762 | 12/1974 | 167/308 |
| CH | 173913 A | 12/1934 | |
| DE | 869247 C | 3/1953 | |
| DE | 049493 | 4/1972 | A61K/7/06 |
| DE | 2322712 | 11/1974 | A61K/7/06 |
| DE | 2438534 | 2/1976 | A61K/7/06 |
| DE | 2452021 | 5/1976 | A61K/7/06 |
| FR | 3203 | 3/1965 | |
| FR | 2393570 | 6/1977 | A61K/7/06 |
| GB | 874368 | 8/1961 | |
| GB | 1237656 | 6/1971 | A61K/7/06 |
| GB | 2235380 A | 3/1991 | |
| JP | 56110607 | 9/1981 | A61K/7/06 |

(List continued on next page.)

*Primary Examiner*—David J. Walczak
(74) *Attorney, Agent, or Firm*—Jack L. Onay, Jr.; Brian M. Bolan; Brent M. Peebles

(57) ABSTRACT

A fluid applicator having a body with a fluid inlet in communication with a reservoir of fluid to be dispensed. The applicator further includes a plurality of applicator tines extending outwardly from an application area of the body, and the tines are at least partially flexible. Moreover, at least some of the tines include a fluid pathway. Additionally, the applicator further includes a handle portion generally above the application area. An actuator is located on the body adjacent the front end and generally above and off-center from the application area. The actuator is operably configured to selectively dispense a predetermined amount of fluid to the fluid pathways of the tines for accurate and consistent dispensing and application of the fluid to a target surface.

45 Claims, 10 Drawing Sheets

FOREIGN PATENT DOCUMENTS

| | | | | |
|---|---|---|---|---|
| JP | 01135711 | | 5/1989 | ..... A61K/7/06 |
| JP | 03141213 | A2 | 6/1991 | |
| JP | 07157415 | | 6/1995 | ..... A61K/7/06 |
| JP | 10273422 | | 10/1998 | ..... A61K/7/06 |
| JP | 10273423 | | 10/1998 | ..... A61K/7/06 |
| JP | 10273424 | | 10/1998 | ..... A61K/7/06 |
| JP | 11302133 | | 11/1999 | ..... A61K/7/06 |
| JP | 11322545 | | 11/1999 | ..... A61K/7/06 |
| NL | 730966 | | 1/1975 | ..... A61K/7/08 |
| SU | 912168 | | 7/1980 | |
| WO | WO-98/51185 | A1 | 11/1998 | |
| WO | WO-02/07685 | A2 | 1/2002 | |
| ZA | 680962 | | 11/1968 | ..... 167/87 |

* cited by examiner

FLUID APPLICATOR

The present invention relates to an improved fluid applicator, and more particularly, to a combination applicator for manually massaging and applying a fluid to the skin or scalp.

BACKGROUND OF THE INVENTION

Fluid applicators and massage devices are used to manually massage the skin or scalp, as well as to apply various lubricating and moisturizing liquids. While such liquids and massages can be applied manually, numerous types of devices have been developed to simplify and enhance the process. Applicators for dispensing fluid product and for applying and/or "working" the product onto or into a surface have been combined into a single device to help improve the distribution of a medication, lotion, treatment or other fluid that has been applied, for example, to the skin or scalp. Examples of such fluids may include dandruff preventing medication, tanning lotion, moisturizer, sun screen or hair growth treatment. Moreover, although typical devices are used for human applications, in some cases the applicators could be used to apply liquid fluids such as flee/tick killer to the coat of a pet or other animal.

Nonetheless, most of these devices suffer from a multitude of deficiencies that limit their practicability and usefulness. For example, although many of these devices provide an applicator for a fluid, the dosages are often difficult to estimate and apply resulting in uneven distribution of the fluid to the treatment area. This uneven distribution may cause some areas of the skin or scalp to receive too much product, while other areas receive too little. Moreover, many times applicators cannot reliably "target" the dispensing or application of the product, or consistently dispense a fluid due to the orientation of the applicator at the time the fluid is being applied, and depending on whether the applicator is being used in a wet or dry environment. As a result, it would be advantageous to have an improved fluid applicator that provided repeatable dosages of a fluid upon actuation by a user. Moreover, it would be highly desirable if a device dispensed a fluid consistently no matter the orientation in which the device was held and independent of the surrounding wet or dry environment.

One of the further drawbacks to a typical prior art fluid applicator is that most of these applicators fail to thoroughly apply a fluid to a desired area such as on the skin or scalp. For example, although many prior art applicators deliver a fluid to the skin or scalp, most fail to promote intimate contact between the applicator and the target surface. Such failure typically results in excessive use or waste of the fluid due to inadequate delivery of the fluid to the regions to be treated. As a result, it would be advantageous to have an improved fluid applicator that facilitated contact between the applicator and the targeted delivery surface, and provided for a more convenient and accurate placement of the fluid dose.

Finally, many prior art devices fail to allow for easy alternation between dispensing and massaging due to an inconveniently located actuator. For example, in U.S. Pat. No. 5,297,882 to Kornides, a user would practically have to stop massaging the skin or scalp in order to apply the fluid through the bristles due to the arrangement of the dispensing element and the practical requirements for handling the device for massaging. Moreover, many devices, such as that disclosed in U.S. Pat. No. 5,131,384 to Obagi, may be difficult to grip due to having a bulky size, thus defeating the purpose of the device. Additionally, many prior art applicators are made from hard, inflexible materials that may provide some discomfort if the applicators were to contact the skin or scalp. Consequently, it would be highly desirable to have an improved fluid applicator that was not only easy to grip and easy to fit in an average person's hand, but also allowed for easy alternation between applying a fluid and massaging. Moreover, it would be advantageous if the applicator provided a unique combination of good/skin scalp stimulation, and a pleasant and soft feel upon contact with the skin or scalp.

SUMMARY OF THE INVENTION

In an exemplary embodiment of the invention, a fluid applicator comprises a body having a fluid inlet in communication with a reservoir of fluid to be dispensed. The body also comprises a front end and a rear end. The applicator further includes a plurality of applicator tines extending outwardly from an application area of the body, wherein the tines are at least partially flexible and wherein at least some of the tines could comprise a fluid pathway. Additionally, the applicator will further include a handle portion generally above the application area. Finally, the applicator could include an actuator located on the body adjacent the front end and generally above and off-center from the applicator area. The actuator should be operably configured to selectively dispense a predetermined amount of fluid to the fluid pathways.

In an alternate embodiment of the invention, a fluid applicator comprises a body configured to accommodate a fluid reservoir and also comprises a handle area and an application area. The applicator further includes a plurality of applicator tines integrally attached to an underside of the body wherein at least some of the plurality of tines comprise a fluid pathway. Moreover, the applicator could comprise a pump having a fluid inlet in communication with the reservoir and a fluid outlet integrally connected to a manifold system. The manifold system has a plurality of passageways configured to deliver a substantially consistent predetermined portion of fluid to the fluid pathways. Lastly, the applicator is provided with an actuator moveably connected to the body that is operably configured to selectively dispense a predetermined amount of fluid to the fluid pathways.

Still other advantages and novel features of the present invention will become apparent to those skilled in the art from the following detailed description, which simply illustrates various modes contemplated for carrying out the invention. As will be realized, the invention is capable of other different obvious aspects, all without departing from the invention. Accordingly, the drawings and descriptions are illustrative in nature and not restrictive.

BRIEF DESCRIPTION OF THE DRAWINGS

While the specification concludes with claims particularly pointing out and distinctly claiming the present invention, it is believed that the same will be better understood from the following description, taken in conjunction with the accompanying drawings, in which:

DETAILED DESCRIPTION OF EXEMPLARY EMBODIMENTS

Reference will now be made in detail to various exemplary embodiments of the invention, several of which are also illustrative in the accompanying drawings, wherein like numerals indicate the same element throughout the views.

Figure 1:
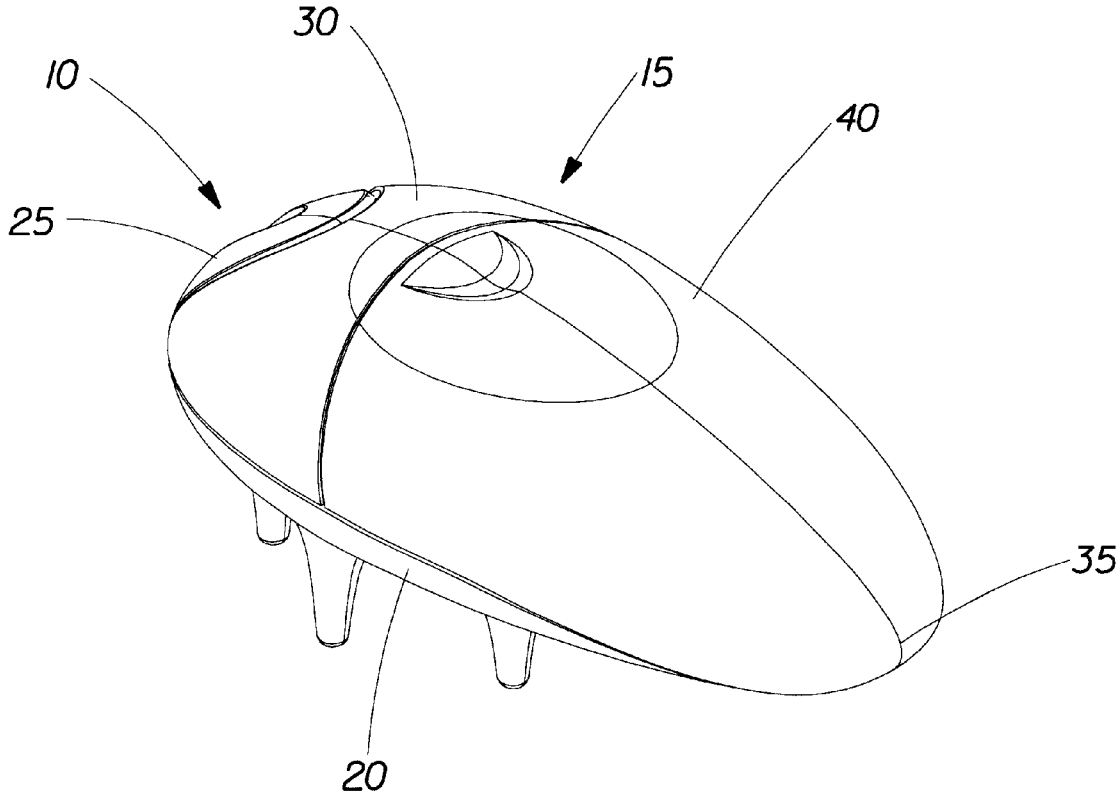
FIG. 1. depicts a perspective view of an exemplary embodiment of an improved fluid applicator in accordance with the present invention.
Figure 2:
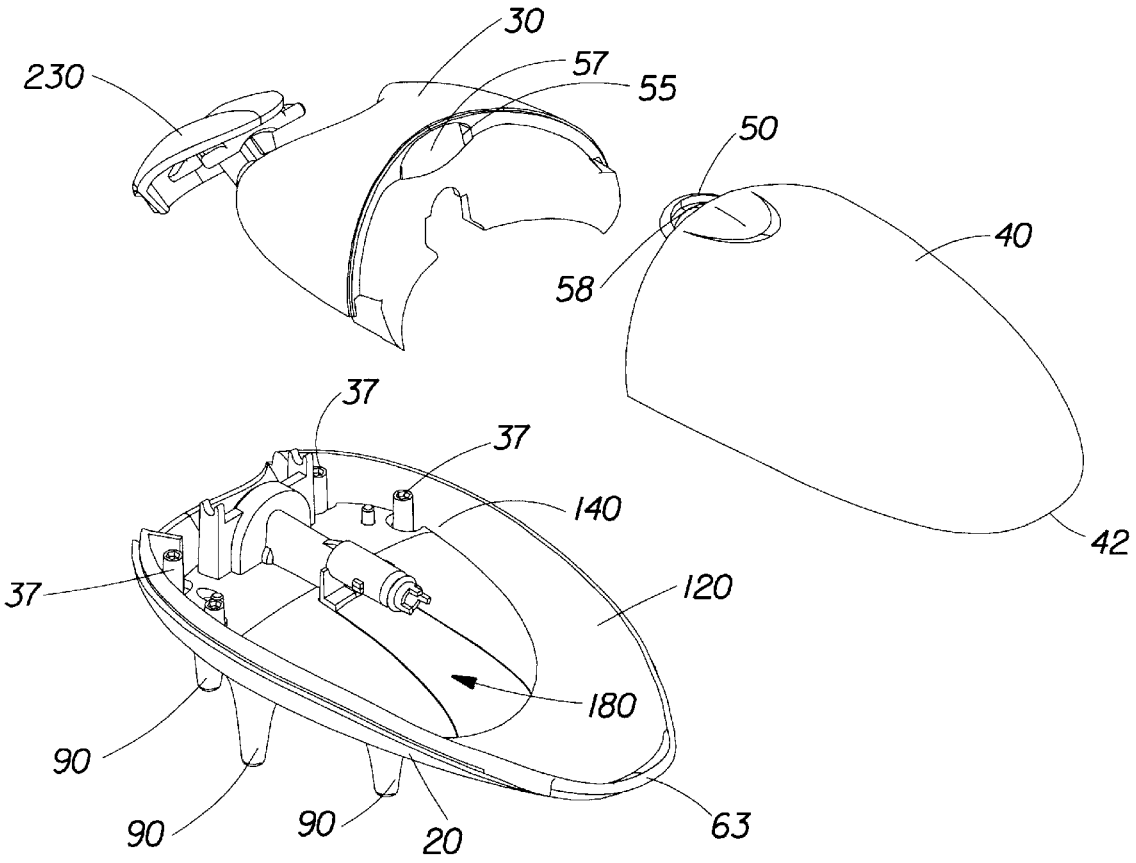
FIG. 2. depicts a partially exploded view of some of the components of the applicator of FIG. 1 in accordance with the present invention.

FIG. 1. depicts a non-limiting exemplary embodiment of an improved fluid applicator 10 made in accordance with the present invention. As FIG. 1 illustrates, the improved fluid applicator 10 comprises a body 15 having a front end 25 and a rear end 35. The body 15 is further comprised of a base 20, a bezel 30 and a cover 40, wherein the bezel 30 and cover 40 are configured for integral connection with the base 20. Although a bezel 30 could engage a base 20 in any number of ways, in an exemplary embodiment of the invention, the bezel 30 is designed to securely snap into engagement. For example, as illustrated in FIG. 2, the bezel 30 may comprise a plurality of pegs 32 that are configured to engage a corresponding plurality of connectors 37 integrally formed with or attached to the base 20. While these parts could be permanently attached, as will be further understood from the description herein, it may be desired in some applications to make at least some of these parts selectively disengageable for ease of manufacture, replacement of expendable parts, repair, cleaning or the like.

It should be recognized that the components of the body 15, namely the base 20, the bezel 30 and the cover 40, could be manufactured from nearly any type of material such as plastic resin, but in an exemplary embodiment of the invention, these components are manufactured from a lightweight and durable thermoplastic material such as polypropylene, polyethylene, polyester, polycarbonate or polyvinylchloride. Moreover, it should be recognized that the base 20 and the bezel 30 could be designed and manufactured as a single integral component, or as an assembly of any number of parts.

In this illustrated embodiment, the cover 40 is configured to engage both a base 20 and a bezel 30. Although a cover 40 could engage either of these components in a variety of ways, in a non-limiting embodiment of the invention, the cover 40 slidably contacts the base 20 along a rim 42 and also snaps into engagement with the bezel 30. In this way, the cover 40 can be readily disengaged and removed when desired. As seen in FIG. 2, the bezel 30 may further include a slot 55 having a cavity 57, and one end of the cover 40 may further include a tab 50 having a protuberance 58. The tab 50, or similar structure, could slidably engage the slot 55 so that the protuberance 58 snaps into engagement with the cavity 57 for selective captive interaction.

Figure 3:
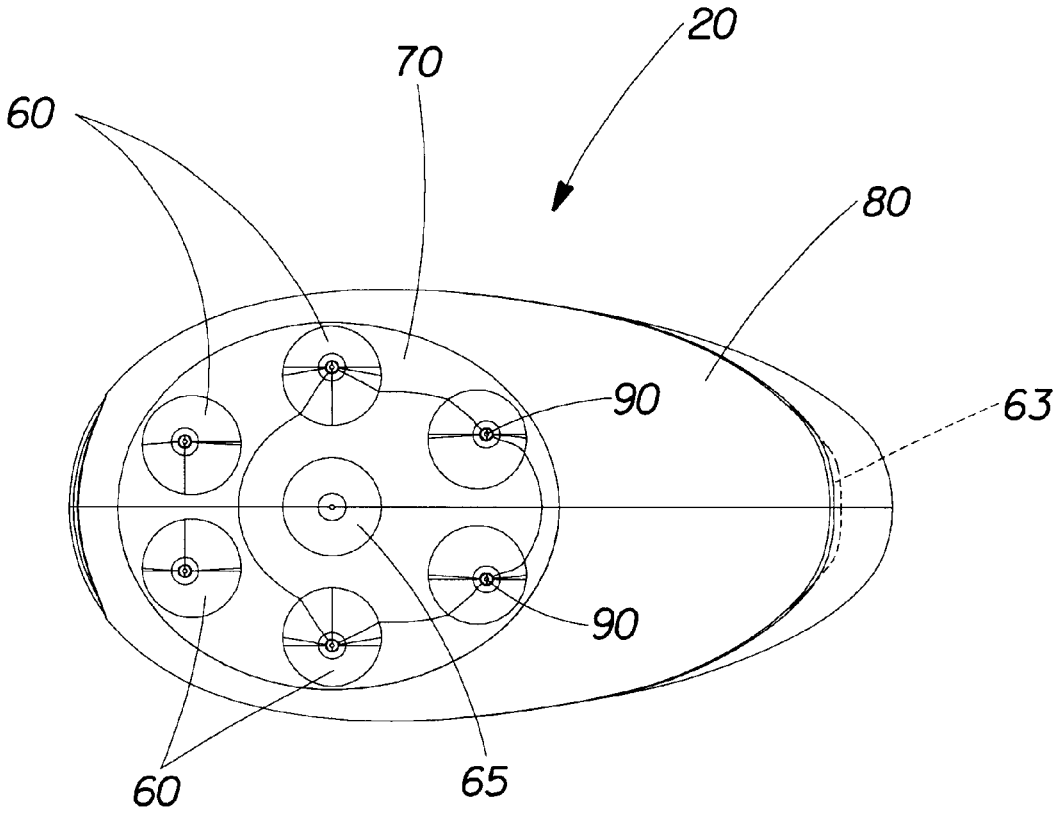
FIG. 3. depicts a bottom plan view of an exemplary embodiment of a fluid applicator of the present invention.

Additionally, as further depicted in FIGS. 2 and 3, the base 20 could further comprise a lip 63 located near the rear end 35 of the base 20, which is configured to engage an inner portion of the rim 42 of the cover 40. In this way, once the tab 50 snaps into engagement with the slot 55 on the bezel 30, the lip 63 on the base engages an inner portion of the rim 42, thereby allowing the cover 40 to be securely attached to both the bezel 30 and the base 20. The tab 50 is designed such that manually depressing a portion of the cover 40 near the tab 50 causes the protuberance 58 to disengage from the cavity 57, allowing the cover 40 to be easily, slidably removed and replaced. This feature allows access to the interior of the body 15 for cleaning, repair or replacement of an optionally permanent, interchangeable, or refillable fluid applicator 10.

In an exemplary embodiment of the invention, a reservoir 120 is defined within the body 15 and can be enclosed by the engagement of the base 20, the bezel 30 and the cover 40. As indicated, the reservoir 120 can be made easily accessible when a cover 40 is removed from the applicator 10. A reservoir 120 is used to house a medication, lotion, treatment or other fluid that is to be applied to the skin or scalp. Although the reservoir could be designed in numerous ways, in an exemplary embodiment of the invention, the reservoir 120 houses refillable, replaceable and/or interchangeable cartridges or packets. For example, the reservoir 120 could house individualized packets of a fluid, such as a dandruff control medication, that are replaceable upon expiration or depletion, or interchanged with a packet containing an alternate type of fluid such as a hair growth treatment. The use of such replaceable and interchangeable packets within the reservoir facilitates the use of the applicator 10 in either a wet or dry environment.

It should further be recognized in an alternate embodiment of the invention that the applicator 10 could be designed such that the entire applicator is disposable. In other words, it is conceivable that the applicator 10 be designed such that the reservoir 120 is neither refillable nor replaceable. For example, the applicator 10 could be manufactured with a particular type of fluid, such as a dandruff control medication, housed in the reservoir, and upon expiration or depletion of the liquid product, the user would dispose of the applicator and purchase another.

As illustrated in FIG. 3, an exemplary embodiment of the present invention might comprise a plurality of application tines 60 extending outwardly from an application area 70 of the body 15, such as on the underside of the base 20. It should be recognized that the shape, number, physical characteristics and pattern of the tines 60 could vary depending on the applications and other preferences for comfort, ornamental appearance, cost objectives and the like. However, in a non-limiting embodiment of the invention, the application tines 60 are arranged in an at least semi-circular overall pattern within a substantially oval shaped application area 70. Additionally, at least some of the applicator tines 60 should further comprise a fluid pathway 90 to allow a fluid to be dispensed through the tine 60, as will be discussed below.

As will be understood, the total area on the body 15 can be further defined by an application area 70 and a handle area 80. The application area 70 is defined by the area that comprises a pattern associated with an arrangement of the application tines 60. In other words, in an exemplary embodiment of the invention, the application area 70 is the semi-circular area (e.g. a substantially oval-shaped area in FIG. 3) encompassing the plurality of application tines 60. The area outside the application area 70 is termed the handle area 80, as it provides a gripping area for use of the applicator. Put another way, the handle area 80 can encompass every portion of the applicator 10 other than the application area 70. It is contemplated that an applicator 10 of the present invention can be designed in a compact and ergonomic manner so as to easily fit in an average person's hand and should be easy to grip. As further depicted in FIG. 3, in one embodiment of the invention, for use in the field of dandruff prevention or treatment, the application area 70 might best be less than about 80% of the total area on the underside of the base 20, and more desirably less than about 50% of the total area on the underside of the base 20.

Figure 4:
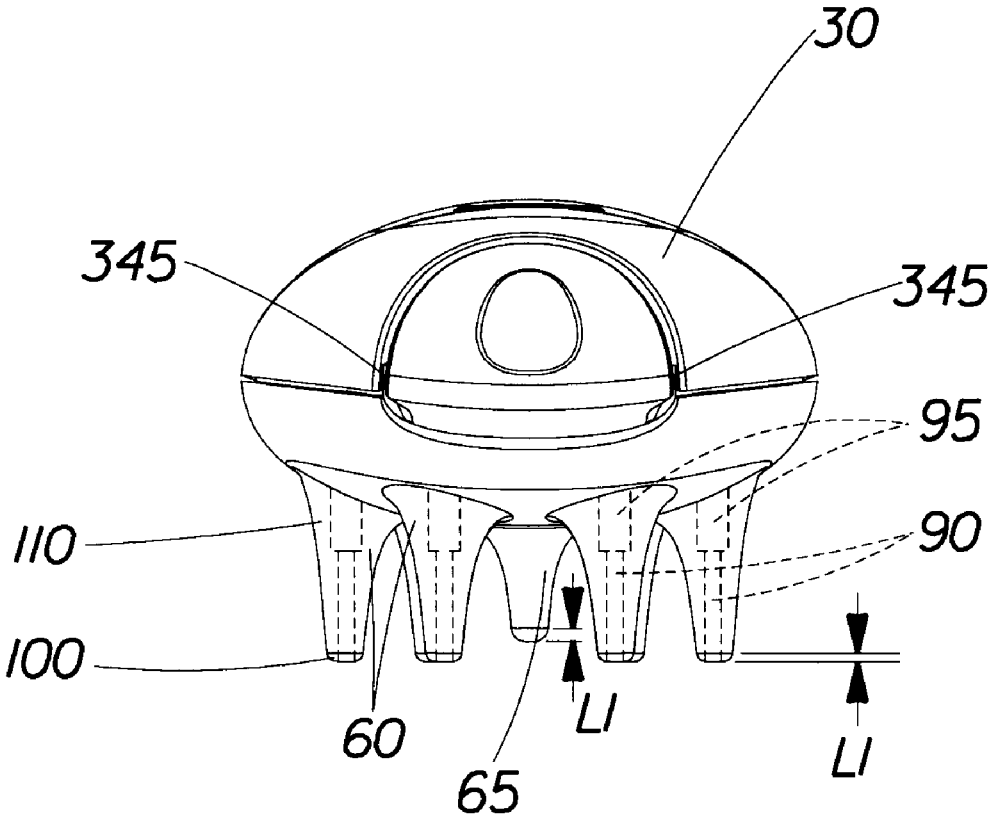
FIG. 4. depicts a front elevational view of an exemplary embodiment of an improved fluid applicator in accordance with the present invention.

In a non-limiting exemplary embodiment of the invention, the improved fluid applicator 10 has a total of seven tines; six application tines 60 located on the periphery of the application area 70 and one "dummy" or non-dispensing tine 65 located near the center of the application area 70. As illustrated in FIG. 4, in such an exemplary embodiment, the applicator tines 60 are generally of equal length and comparably longer than the dummy tine 65 due to the contoured, generally convex shape of the scalp. The shorter dummy tine 65 generally allows each of the tines 60, including the dummy tine 65, to have intimate contact with the scalp, thus allowing each tine to stimulate a portion of the skin or scalp. Moreover, including one or more dummy tines 65 can also be beneficial to facilitate and simplify the manufacturing and molding process for the applicator 10. It should be recognized, however, that the dummy tine 65 could be manufactured to a variety of lengths depending on the designated use of the applicator 10. For example, it is conceivable that the dummy tine 65 be manufactured of equal or greater length than the application tines 60, if the applicator 10 were required to be used on a flat, concave or multi-dimensional surface.

Although the physical characteristics of the tines 60, including the dummy tine 65, could vary, in the embodiment of the invention shown in FIG. 4, the tines 60 extend outwardly from the application area 70 of the base 20, and are generally cone shaped to facilitate ease of combing the applicator 10 through hair on the scalp. Each applicator tine 60 includes a base portion 110 adjacent its proximal end and a tip portion 100 adjacent its distal end, wherein the base portion 110 is connected to the underside of the base 20. Additionally, for massaging applications, the base portion 110 of the tines 60 should generally be more rigid in nature than the tip portion 100. In particular, the base portion 110 should be stronger, reinforced, or thicker than the otherwise more flexible, compressible, thinner or less strong tip, either by structural design and/or material selection or variation. Accordingly, the tine base should be substantially rigid to provide support to the flexible tine tips and should facilitate application dispensing and/or massaging as desired.

The tip portion 100, having a length generally illustrated by a distance $L_1$, should be generally soft to the touch, flexible and compressible. These characteristics should provide the application tines 60 and the dummy tine 65 with a unique combination of good skin/scalp stimulation while also providing a pleasant feel upon contact. Additionally, because the tip portion 100 facilitates intimate contact with the skin or scalp, it should also help optimally disperse any fluid and optimize the amount of fluid used to treat a particular area.

In an exemplary embodiment of the invention, the total length of the applicator tines 60 should preferably range in total length from about from about 15 mm to about 20 mm, wherein the tip portion 100, defined by distance $L_1$, preferably ranges in length from about 2mm to about 10 mm, with the base portion 110 comprising the remainder. Moreover, it should also be noted that in an exemplary embodiment of the invention the diameter of the tines at the base portion 110 adjacent the body 15, should range in width from about 7 mm to about 11 mm, and the diameter of the application tines 60 at the tip portion 100 adjacent the distal end should range in width from about 2 mm to about 4 mm.

Although it is feasible to manufacture the application tines 60, including the dummy tine 65, from a single material such as polypropylene, polyethylene, thermoplastic elastomer or other material having similar characteristics, it may be difficult to create tines 60 as a single structure or single material having a sufficiently rigid base and flexible and compressible tip portion 100, given the structural features that would need to be taken into account such as wall thickness, length, width, geometric configuration, etc. Overall, the use of a single material may either provide too rigid a tip portion 100 or too flexible a base portion 110, thereby limiting the usefulness of the applicator 10. As a result, in some embodiments of the invention, the application tines 60 including the dummy tine 65 could be more conveniently or simply manufactured from different material constituents, such as a more rigid material for the base portion 110, and a relatively soft, flexible and compressible material for the tip portion 100.

In a non-limiting exemplary embodiment of the present invention, the tines 60 including the dummy tine 65 could be manufactured using a two-shot injection molding manufacturing process. In particular, the base portion 110 of the tines 60 and the dummy tine 65 might be manufactured as a single integrated component of the base 20 due to the desired substantially rigid nature of both structures. Manufacturing this integrated component comprises the first shot in the two-shot manufacturing process. A suitable material may include polypropylene Pro-fax SR-549M such as available from Montell, although, other thermoplastic materials such as polypropylene, polyethylene, polyester, polycarbonate or polyvinylchloride would also be suitable for this purpose. In an exemplary device for scalp applications, the selection of such a material might best include materials having a flexible modulus of about 50,000 psi to about 200,000 psi, wherein flexible modulus is defined as the ratio of stress to corresponding strain within an elastic limit.

The second shot of the contemplated two-shot manufacturing process comprises molding of an outer tine material over the base tines, and perhaps over the entire application area 70 including the base tines, to create the soft, flexible and compressible tip portion 100 associated with the application tines 60 and dummy tine 65. Although this outer tine material could be formed to the base 20 in a variety of ways, in one embodiment of the invention, the outer tine material is chemically bonded over the entire application area 70 due to the compatibility of the materials selected. Put another way, the chemical properties of the constituent materials allow the materials to be selectively bonded in a chemical process. Other methods of bonding the multiple-layers may include the use of adhesives or other alternative mechanical processes. As a result, the entire application area 70 comprises an inner portion manufactured with a rigid material to provide the base of the tines, and an outer portion or surface manufactured with a soft to the touch, flexible and compressible material to provide the tip of the tines.

The outer tine material comprising the tip portion 100 can be manufactured using a soft, flexible and compressible material such as Versaflex ST1025-X, as available from GLS Corporation, however, it should also be recognized that nearly any thermoplastic elastomer, santoprene rubber or other material having similar characteristics could be substituted. Moreover, the selection of such a material should also be directed to the particular application. For example, in a scalp type product application a durometer hardness between about 10 Shore A to about 80 Shore A, and better yet between about 35 Shore A and about 50 Shore A, might be desired, wherein durometer hardness is measured based on initial indentation of the material or indentation after a specified period of time.

Moreover, it should be noted that the outer tine material from which the application tines 60 and dummy tine(s) 65 are manufactured, might be chosen so as to have a high coefficient of friction prior to dispensing a fluid from the applicator 10, and upon dispensing the fluid, the coefficient of friction may be reduced to allow the tines to easily move over the surface being treated. Such friction characteristics might improve the product application process and improve the overall efficiency and acceptability of the applicator. In an alternate embodiment for scalp or other head treatments, the outer tine material could also be treated with a slip agent to reduce the coefficient of friction such that the tines could be readily combed through hair on the skin or scalp.

While it is possible to create an improved fluid applicator 10 without a central dummy tine 65, the dummy tine 65 can be an important part of the two-shot manufacturing process described, because the tine 65 allows for hot-tip gating in the center (or at another desirable location) of the tine arrangement. Without a center tine 65, center gating might not otherwise be practical because of the compactness of the tine arrangement. Moreover, due to the central location of the dummy tine 65, knit lines can be avoided, which should provide for improved aesthetics and integrity of the application area 70. However, it should also be recognized that an improved fluid applicator 10 could be manufactured, wherein the center-tine 65 could not only be used for the injection molding process, but could also be configured to become a dispensing tine.

As further illustrated in FIG. 4, at least some of the application tines 60 comprise a fluid pathway 90 to allow a fluid to be dispensed through the tines 60. In an exemplary embodiment of the invention, the fluid pathways 90 are in fluid communication with the reservoir 120 such that upon actuation of the applicator 10, fluid is dispensed from each of the plurality of tines. It should be recognized that although the diameter of fluid pathways 90 formed within the applicator tines 60 could vary, in general, the diameter of each fluid pathway 90 should be sufficiently large to prevent the tines 60 from being easily "plugged". Moreover the diameter of the fluid pathway 90 should be sufficiently large accommodate a variety of fluids having differing characteristics.

Figure 5A:
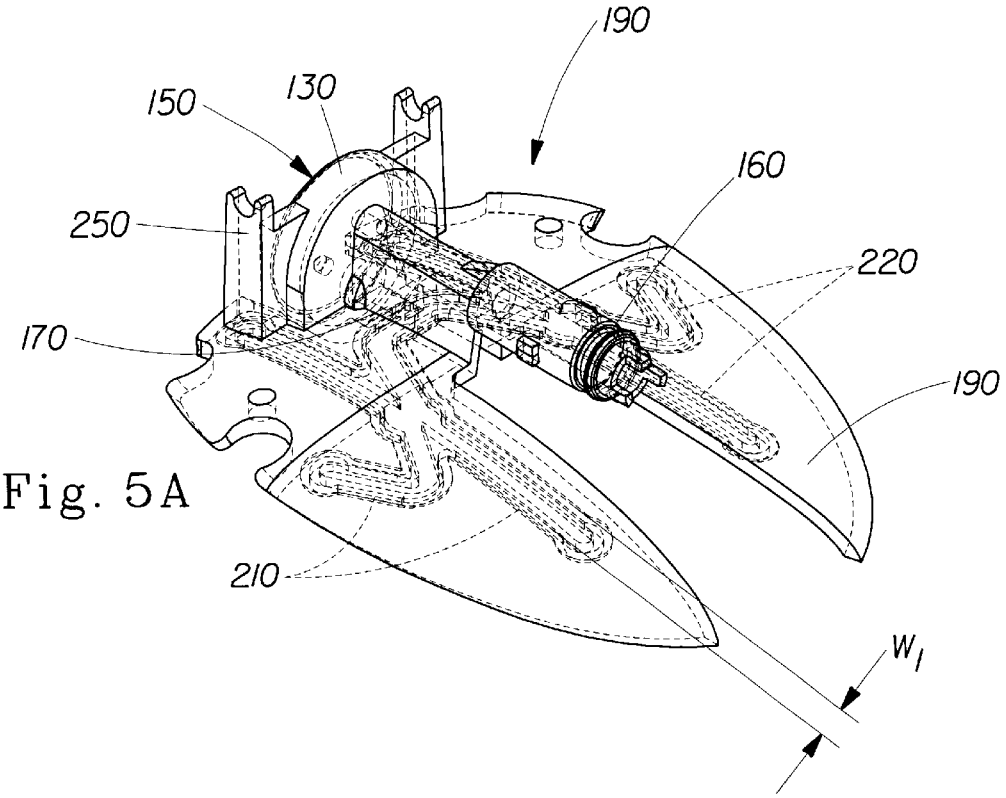
FIGS. 5*a*. and 5*b*. depict a portion of an exemplary embodiment of the present invention, including a fluid pumping arrangement.
Figure 5B:
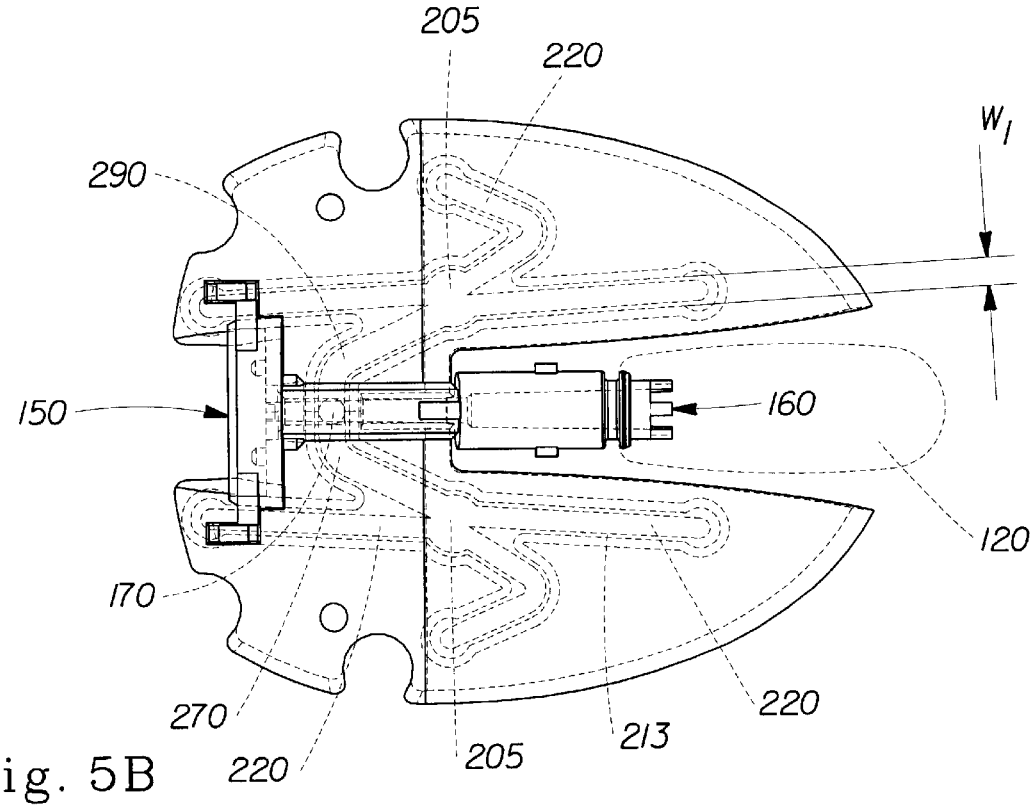

In a non limiting embodiment of the present invention, the fluid applicator 10 further comprises a fluid source that dispenses fluid through the plurality of applicator tines 60. In an exemplary embodiment of the invention as depicted in FIGS. 5*a* and 5*b*, the fluid source could comprise a pump 130 that allows a fluid in the reservoir to be pumped from the reservoir 120 through the tine fluid pathways 90 for application of a fluid to the skin or scalp. In this illustrated embodiment, the pump 130 is connected to a portion of the body 15, such that the pump 130 is securely mounted within a chamber 140 formed within the body 15.

Although, the pump 130 could be any known device that displaces fluid, such as a mechanical displacement pump, in a non-limiting embodiment of the invention the pump 130 comprises a diaphragm pump configured to deliver a predetermined dosage of fluid to the fluid pathways 90 upon actuation. An example of suitable pump can be found in U.S. Pat. No. 5,993,180 to Westerhof et al. In an exemplary embodiment of the present invention, for use in applying anti-dandruff product to the scalp, between about 0.05 ml to about 0.30 ml of fluid might be dispensed from the applicator 10 per actuation, or more precisely between about 0.1 ml to about 0.2 ml might be dispensed per actuation. Of course, the predetermined amount or dosage would likely vary among the wide variety of applications for with the present invention can be implemented.

The diaphragm pump 130 is illustrated as comprising a flexible member 150 having biased characteristics and a memory of an initial position. The pump 130 also comprises a fluid inlet 160 that is in fluid communication with a reservoir 120 (e.g. shown in phantom) of a fluid to be dispensed. Moreover, the pump further comprises a fluid outlet 170 that is also in fluid communication with the fluid pathways 90 associated with each of the application tines 60. For example, upon manual compression of the flexible member 150, a fluid is drawn from the reservoir 120 on the recovery stroke and dispensed to the fluid pathway 90 of each of the application tines 60. Thereafter, the flexible member 150 returns to its initial position, due to the memory of its initial position and the spring back nature of the material, so the process can be repeated. Upon return to its initial position, the flexible member 150 pulls the fluid into its pumping chamber from reservoir 120, to prime the pump for the next dispensing "shot" or dose.

It should be noted that when introducing a new fluid to the reservoir, the pump and dispensing manifold are not entirely filled with fluid. As a result, it may take a number of successive manual compressions of the flexible member 150 to draw the fluid from the reservoir 120 and prime the manifold system to the tip portion 100 of each of the application tines 60. As a result, once this process, termed "priming" the pump is complete, a single manual compression of the flexible member 150, will cause some fluid to dispense from each of the application tines 60.

Moreover, it should further be recognized, that interchanging from one fluid to another, may require that the existing fluid in the pump 130, manifold system 180 and other fluid pathways and passageways be dispensed prior to introduction of the second fluid to prevent contamination of the second fluid. In particular, upon removal of the original fluid from the reservoir, it may take a number of manual compressions of the flexible member 150 to draw all of the original fluid out of the system. Thereafter, a second fluid could be introduced to the reservoir, and the pump 130 would once again need to be primed to draw the second fluid to the tip portion 100 of the application tines 60. In this way, fluids contained in reservoir 120 could be refilled, replaced or interchanged with a variety of alternate fluids allowing the applicator 10 to have multiple uses.

Figure 6A:
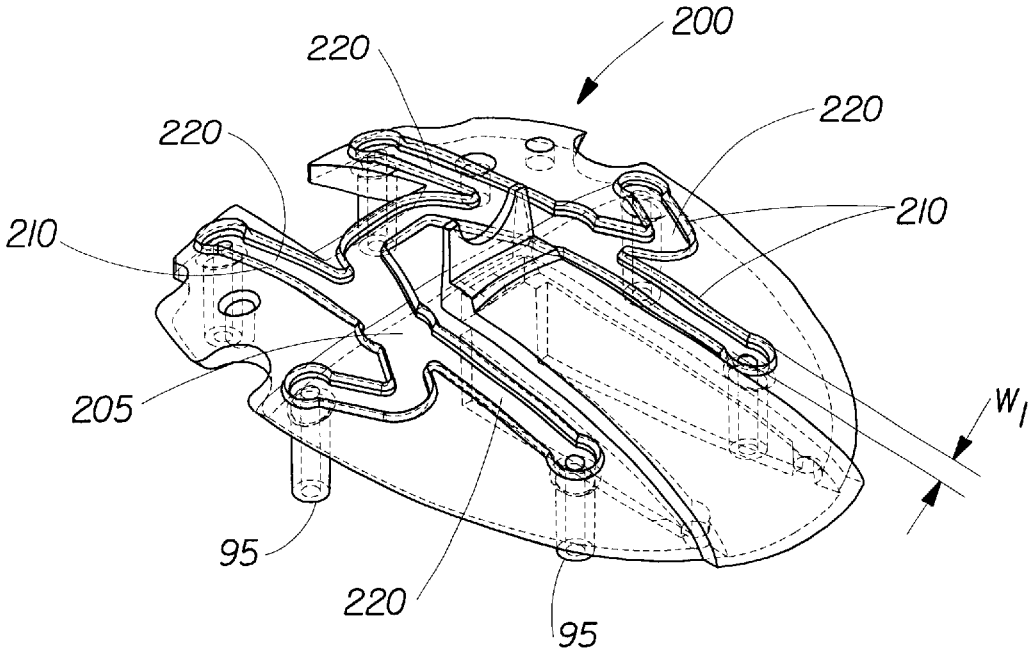
FIGS. 6*a*. and 6*b*. depict a portion of an exemplary embodiment of the present invention, including details of a manifold system.
Figure 6B:
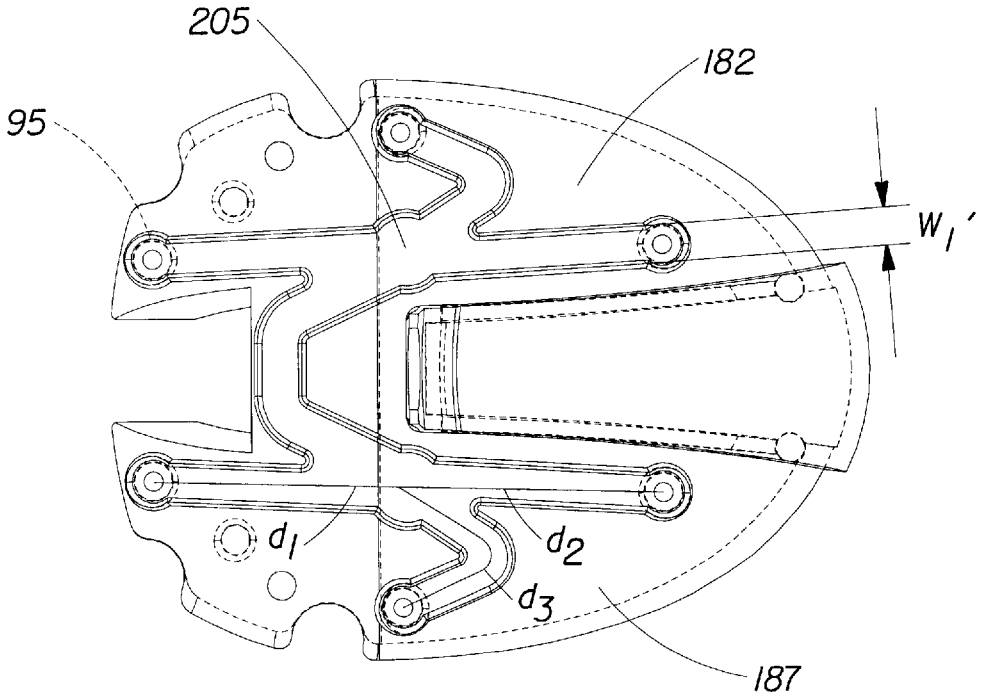

In the exemplary embodiment shown in FIGS. 5 and 6, a pump 130 could be integrally connected to a manifold system 180. The purpose of a manifold system 180 is to distribute a fluid being delivered through the pump 130 to each of the fluid pathways 90 of the plurality of application tines 60. As illustrated in FIGS. 5*a* and 6*a*, respectively, the manifold system 180 is comprised of an upper manifold portion 190 and a lower manifold portion 200, which are configured to be engaged. Although these two components could be engaged in a multitude of ways, or unitarily formed, in one embodiment of the invention they are made of plastic and ultrasonically welded. As further depicted in FIGS. 5*a* and 6*a*, channel walls 210 are embedded as mirror images in both the upper 190 and lower 200 manifold portions to create appropriately sized distribution channels. The channel walls 210 have a wall height such that upon engagement of the manifold portions (190, 200), the channel walls 210 define a series of passageways 220 for a fluid to travel.

In an exemplary embodiment of the invention, the manifold system 180 is designed so that upon manual compression of the flexible member 150 of the pump 130, a substantially consistent predetermined portion of fluid should be dispensed to the individual fluid pathways 90. In other words, the manifold system 180 can be designed such that upon actuation of the pump 130, each application tine 60 should dispense a consistent dosage of fluid. In this example, the dosage of fluid being dispensed from each tine 60 does not necessarily have to be equal, rather the dosage dispensed from each tine 60 should be consistent, uniform and repeatable from one actuation to the next.

Nonetheless, in a non-limiting, exemplary embodiment of the invention, not only does the fluid dispense in a substantially consistent manner, but each of the corresponding manifold passageways and fluid pathways in the dispensing tines 60 is sized and configured to dispense a substantially equal portion or volume of the fluid through each tine 60. The applicator 10 is able to achieve this consistency because, unlike typical applicators in which a fluid is distributed in a serial (i.e. from one tine to another) arrangement, the manifold system 180 in the present invention distributes the fluid in a parallel arrangement. In other words, the manifold system 180 could distribute a predetermined volume of fluid to each of the plurality of application tines 60 independent of the other tines 60. For example, in the scalp application example of the invention, it might be desired that the volume of fluid dispensed by each application tine 60 should not vary by more than about 15%. In this way, more accurate and optimal dispensing and application can be provided.

In more detail, in an exemplary embodiment of the invention, as depicted in FIG. 5*a*, the manifold system 180 comprises a "T" shaped passageway 290, wherein upon actuation and dispensing a fluid is expelled by the pump through outlet 170 and into the "T" shaped passageway, wherein approximately 50% of the fluid traverses through the left ventricle 182 of the "T" and 50% traverses through the right ventricle 187 of the "T". Additionally, the manifold system 180 is provided with a pair of plenums 205, configured to receive fluid from its corresponding "T" passageway 290. In other words, upon actuation of the pump 130, a fluid dispenses into a passageway 290 and traverses the passageway toward its respective plenum 205. The plenums 205 subsequently fill with fluid, then further dispense the fluid equally toward each of the fluid apertures 95. In an exemplary embodiment of the invention, each plenum 205 is joined to three passageways 220 corresponding to three application tines 60. As will be understood, the number of passageways for each plenum can vary as needed.

In viewing the right ventricle 187 of the manifold system 180, it follows that if the three passageways 220 leading to corresponding application tines 60 are of equivalent length and cross-sectional area, then each fluid aperture 95 should dispense an substantially equal portion of fluid to each fluid pathway 90 associated with an application tine 60. In more detail, as illustrated in FIGS. 5 and 6, the length of a passageway 220 as defined by the distance between the center of the plenum 205 and each fluid aperture 95 are varied. In particular, in the illustrated embodiment of the invention, distance $d_1$ is equivalent in length to distance $d_2$ due to the linear nature of the passageway.

In theory, distance $d_3$, should be longer in length than distances $d_1$ and $d_2$ to account for the "elbow" located in the passageway 220. In particular, computational fluid dynamics suggests that for non-Newtonian fluids, shear thinning at an elbow will reduce viscosity, thus increasing the flow rate of the fluid. As a result, the length of the passageway having the elbow should be longer as compared to the linear passageway 220 to account for the use of a non-Newtonian fluid such as the exemplary dandruff medication. However, in the exemplary embodiment of the invention as depicted in FIGS. 5 and 6, distance $d_3$ is shorter in length than distances $d_1$ and $d_2$. Despite this disparity, the passageways 220 are considered equivalent in length because the volume of fluid dispensed from each application tine 60 does not vary by more than about 15%. Consequently, since each of the three passageways 220 is equivalent in length and has identical cross-sectional areas, the volume of fluid being dispensed through each fluid aperture 95 to each fluid pathway 90 should nearly be equal. Continuing, by way of example only, since the left ventricle of the manifold is a mirror image of the right ventricle of the manifold, the amount of fluid being dispensed through each of the fluid apertures 95 to each fluid pathway 90 associated with each of the application tines 60 should nearly be equal.

In more detail, it should be recognized that the left 182 and right ventricles 187 of the manifold system 180 do not have to be designed as a "mirror images", but may be so designed if an equal distribution of fluid to the plurality of application tines 60 is desired. It will be understood that the design of the manifold system 180 could be altered to account for the use of Newtonian fluids or for virtually any predetermined pattern associated with the arrangement of the application tines 60. Since the volume of fluid to be dispensed from an application tine 60 is a function of the length, cross-section of the passageways and bend associated with a particular passageway 220, as well as the characteristics of the fluid to be passed through the passageway, any combination of passageways 220 and/or plenums 205 could be designed to deliver a substantially consistent predetermined portion of fluid to each of the fluid pathways 90 associated with each of the application tines 60. Moreover, the passageways 220 could not only be designed to provide consistent predetermined portions of a fluid, but, if desired, could also be designed to provide substantially equal portions of fluid to each of the application tines 60.

It should similarly be noted that the purely mechanical method of dispensing a substantially consistent predetermined portion of fluid to each application tine allows the applicator 10 to deliver a consistent amount of fluid regardless of the orientation of the applicator at the time the fluid is being dispensed. In other words, unlike a typical applicator which may dispense more of a fluid in an upright position versus a vertical or upside down position, no matter the orientation of the applicator, the applicator dispenses a substantially consistent predetermined portion of a fluid upon actuation of the pump 130. This feature allows for consistent and repeatable treatment of an area regardless of its orientation to the surface to be treated (e.g. skin or scalp).

As further illustrated in FIGS. 5 and 6, the channel walls 210 on the upper manifold portion 190 are narrower in width $w_1$ than the channel walls 210 of the lower manifold portion 200 labeled $w_1'$. As a result, when the upper and lower manifold portions are engaged the lower manifold portion 200 fits snug over the upper manifold portion 190. This arrangement should facilitate ease of manufacturing by ensuring that the lower manifold portion 200 is similarly situated over the upper manifold 190 for each and every manufactured applicator 10 and should also promote a seal upon engagement of the portions, such as by ultrasonic welding.

Figure 7:
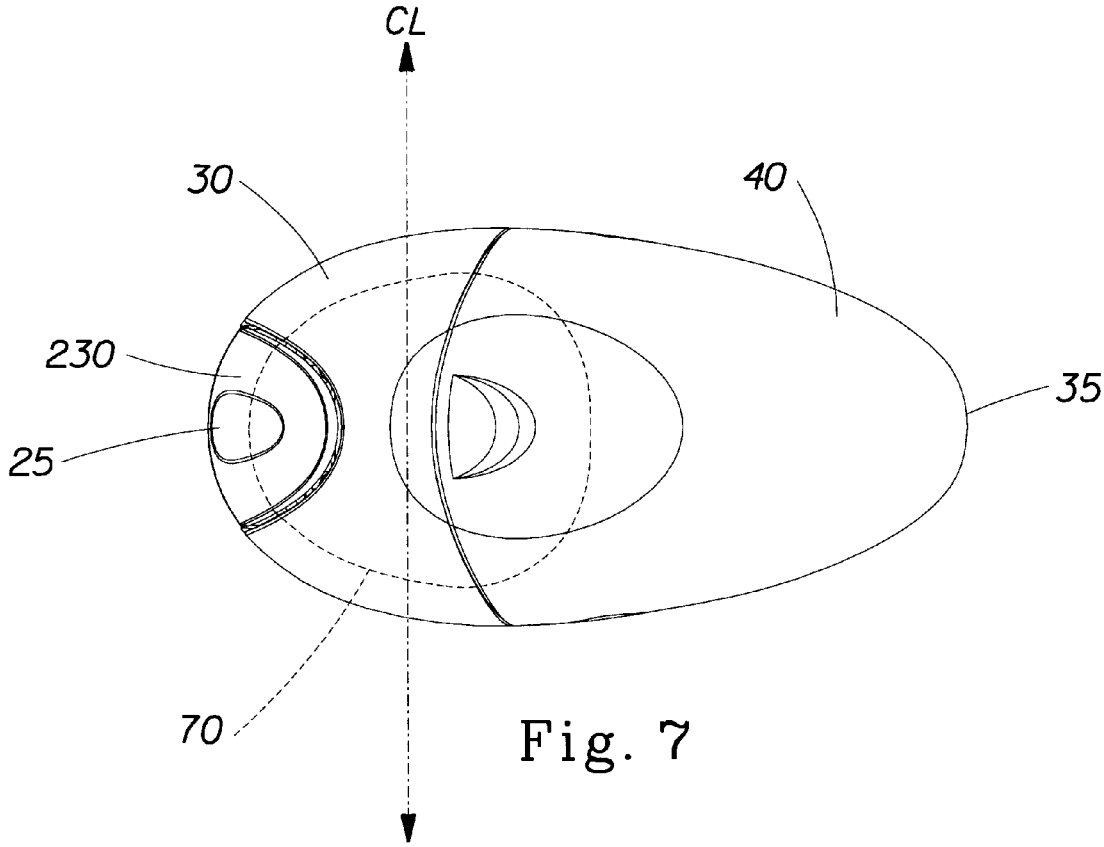
FIG. 7. illustrates a top plan view of an exemplary embodiment of an improved fluid applicator in accordance with the present invention, and showing its application area in phantom.
Figure 8:
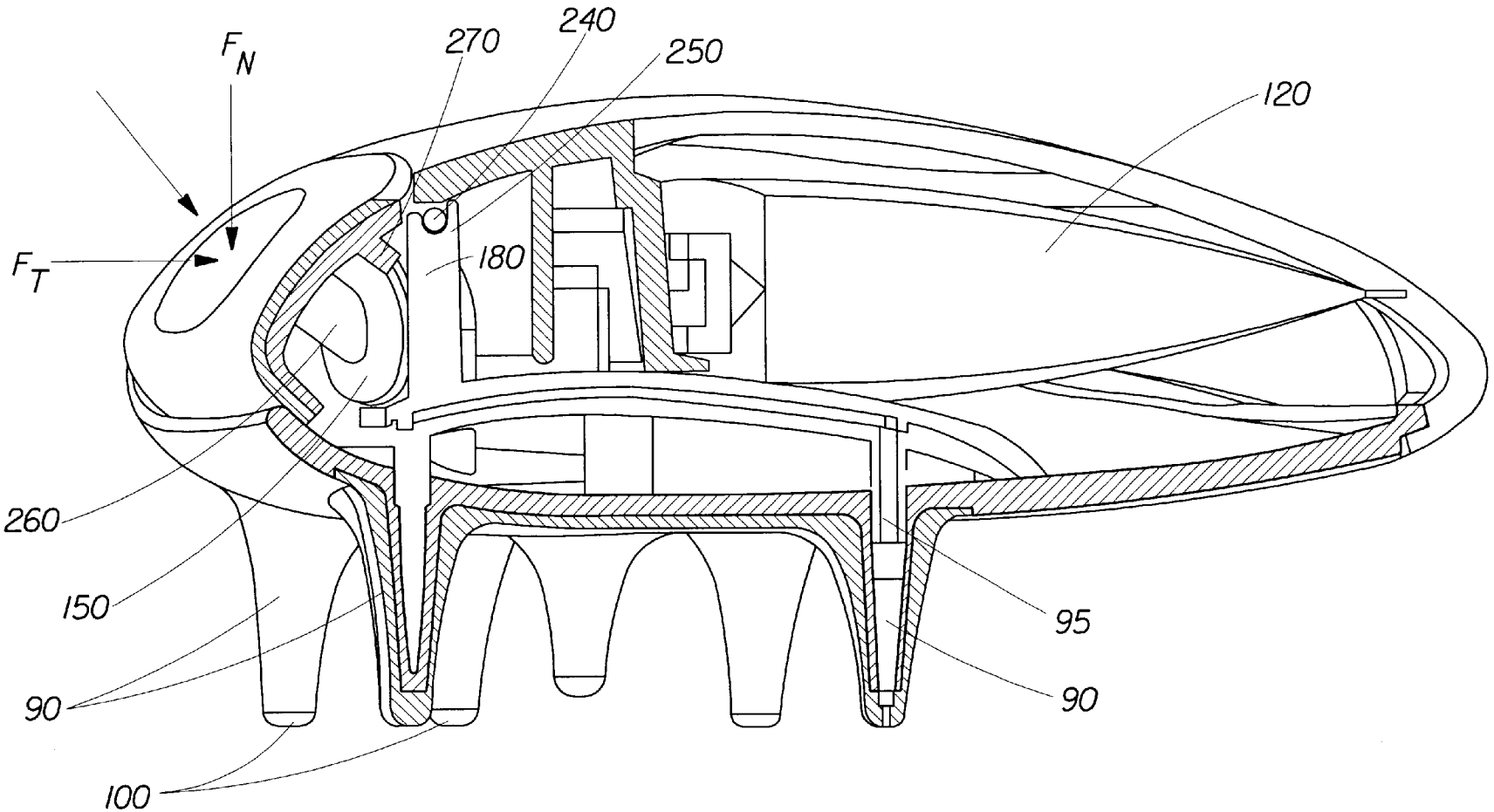
FIG. 8. depicts a cross-sectional view of an exemplary embodiment of a fluid applicator of the present invention.

As Illustrated in FIGS. 7 and 8, the improved fluid applicator 10 of the present invention further includes an actuator 230 operably configured to selectively dispense a predetermined amount of fluid to the fluid pathways 90. Although the actuator 230 can be located in a variety of locations on the applicator 10, in a non-limiting embodiment of the invention the actuator 230 should generally be located on the body 15 adjacent the front end 25 and above and off-center, as designated by the center line $C_L$, from the center of application area 70, as will be discussed further below. Additionally, in an exemplary embodiment of the invention, the actuator 230 should be at least 10% of the size of the application area 70 to facilitate ease of depressing the actuator 230.

For aesthetic purposes, the actuator 230 may also include an enhanced tactile surface, to facilitate user manipulation, comfort and/or control. For example, the actuator 230 might be made using the two-shot manufacturing process comprising a rigid inner material and soft, flexible and compressible outer material. In a non-limiting embodiment of the invention, Polypropylene Pro-fax SR-549M could comprise the rigid inner material and Monoprene 2850M as available from QST could comprise the soft outer material. Once again, however, any material having the desired physical characteristics could provide an equal substitute.

These features should provide optimal user leverage and comfort for manual manipulation of an applicator 10 of the present invention designed for both dispensing and massage/application, by allowing for easy alternation between dispensing and massaging. Moreover, due to the off-center position of the actuator 230, inadvertent dispensing can be minimized and the forces required to manually depress the actuator 230 should facilitate improved massaging of the scalp. For example, the off-center position of the actuator 230 results in both a normal force and a transverse force to depress the actuator, as designated by the arrows, $F_N$ and $F_T$, respectively. The normal force should help facilitate intimate contact between the skin or scalp and the application tines 60, and the transverse force should facilitate repetitive and circular motion that helps stimulate the area being massaged or treated.

In more detail, the actuator 230 is reciprocally attached to a portion of the applicator 10. Although the actuator could be attached to the applicator 10 in a variety of ways, in an exemplary embodiment of the invention the actuator 230 is pivotally attached by a rotatably mounted rod 240 received in a "U" shaped holder or bearing yoke 250 that is integrally connected to the pump and manifold system 180. The actuator 230 may further comprise a compressing rod 260, such that in a resting position, the compressing rod 260 is adjacent to or abuts the outer surface of flexible member 150 of the pump 130. Consequently, upon manually depressing the actuator 230 and causing the actuator to pivot, the compressing arm 260 compresses flexible member 150, activating the pump 130. Upon releasing the actuator, both the flexible member 150 and the actuator 230 are returned to their initial positions due to the spring back nature of the flexible member 150. Consequently, the process of manually depressing the actuator 230 to draw additional fluid into the pump chamber for dispensing through the system can be repeated.

Figure 9:
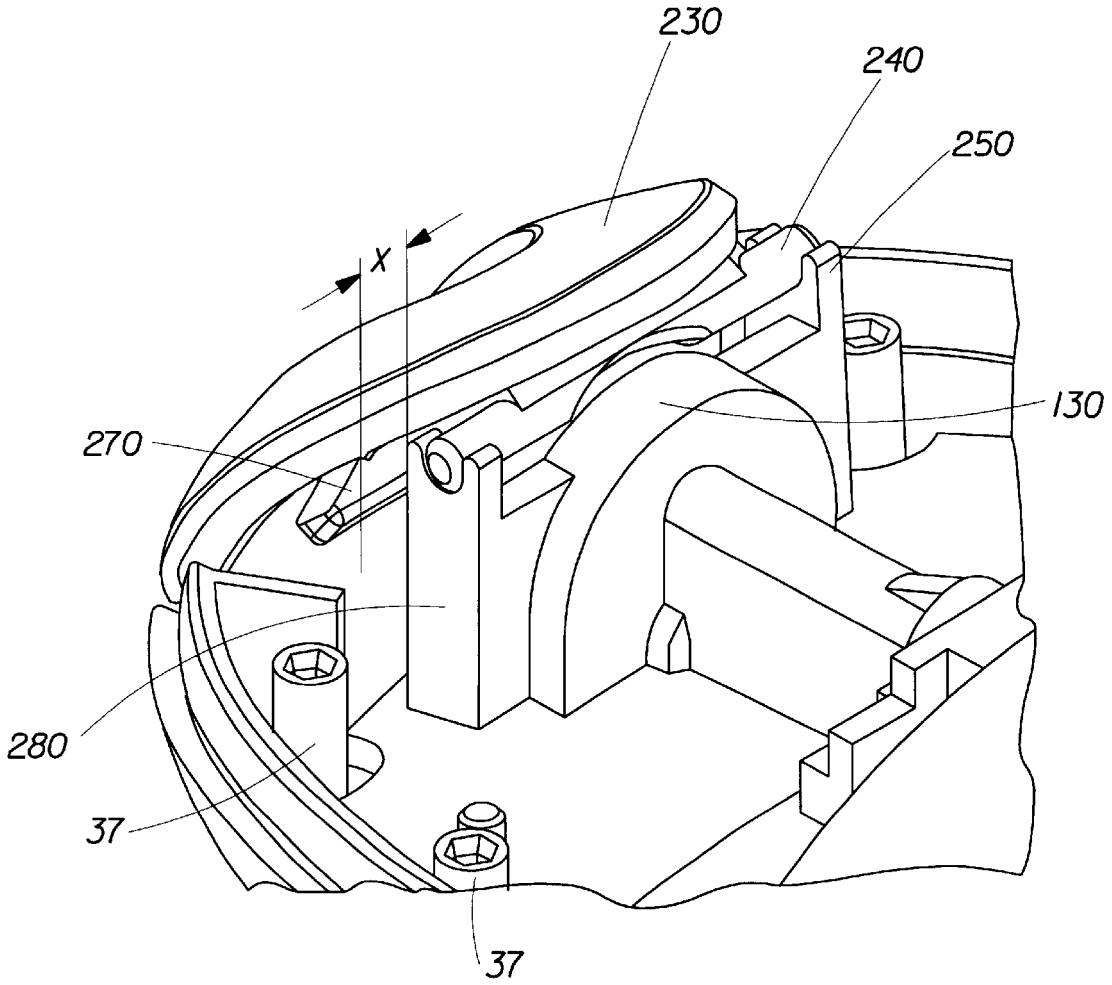
FIG. 9. depicts a partial, enlarged view of a portion of an exemplary embodiment of the present invention; and, FIGS. 10*a*. and 10*b*. depicts an alternate embodiment of an applicator system in accordance with the present invention.

The actuator 230 may further comprise a stopping mechanism or stroke limiter 270 that also acts as a tactile indicator to provide feedback to the user to signal completion of dispensing. In particular, as seen best in FIG. 9, in an at rest position, the stopping mechanism 270 is a distance x from a stopping wall 280, wherein upon manually depressing the actuator 230, the actuator moves until the stopping mechanism 270 abuts the stopping wall 280. Once the stopping mechanism 270 contacts stopping wall 280, the user feels a positive stop and recognizes that the application is complete. It should further be recognized that although the present invention utilizes a positive mechanical stop 270, various alternative or additional tactile (and/or audible) sensors could be incorporated, such as "clicking" mechanism or the like. Consequently, timing and/or skill on the part of the user is unnecessary to achieve a consistent and uniform dosage with every actuation of the applicator.

Although one of the reasons for incorporating a stopping mechanism 270 with an actuator 230 is to provide a tactile signal to a user, a stopping mechanism 270 or other tactile sensor could be adapted for other purposes. For example, a stopping mechanism 270 could be adapted with an alternative mechanical displacement pump to regulate or control the dosage being administered. Moreover, a stopping mechanism 270 protects the flexible member 150 of a diaphragm pump 130 from unnecessary "wear and tear" or abuse by ensuring that the flexible member is limited to moving a certain distance with every actuation.

Figure 10A:
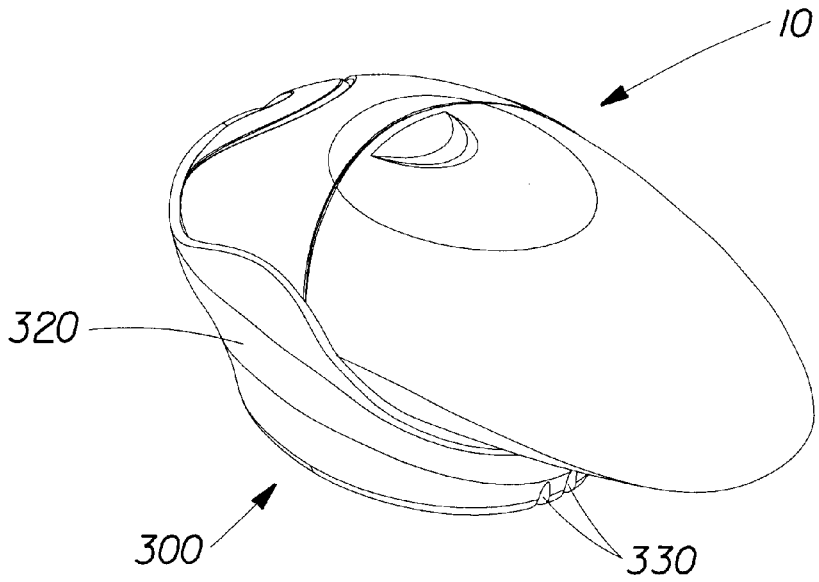
Figure 10B:
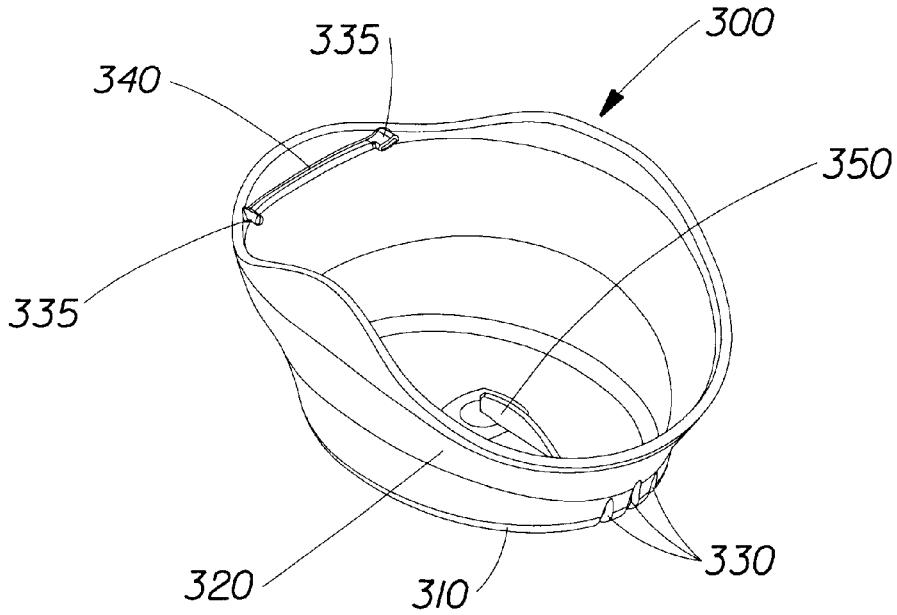

As depicted in FIGS. 10*a* and 10*b*, the improved fluid applicator 10 could further be provided with a protective closure 300. Although the protective closure 300 could be of a variety of shapes and sizes, in general the closure 300 is designed to encompass the application tines 60 of the applicator 10 and protect them against compression or damage during non-use. In an exemplary embodiment of the invention, the walls 320 of the protective closure 300 are generally cylindrical in design and are integrally attached to a flat bottom wall 310. The walls 320 are configured to engage a portion of the applicator 10 and the flat bottom wall 310 is configured to provide a suitable base within which the fluid applicator 10 can rest. Closure 300 could also be designed to sealingly attach to applicator 10 to minimize product dry out, leakage, and/or contamination for storage, travel or child-proof protection.

The protective closure 300 could further be comprised of a center tine locator 350, which is configured to contact the center tine 65, causing the applicator 10 to be securely positioned in the protective closure 300. Moreover, the closure 300 could further include an actuator lock 340 which should prevent inadvertent dispensing of medication or treatment when the applicator 10 is not in use. In a non-limiting embodiment of the invention, the actuator lock 340 includes a pair of insert tabs 335, such that when the applicator 10 is at rest in the protective closure 300, the insert tabs 335 rest between an opening 345 defined between the base 20 and the actuator 230, as best seen in FIG. 4. Thus, the actuator 230 should be prevented from moving, and prevented from inadvertently dispensing a fluid. Finally, the protective closure 300 could alternatively include a plurality of drainage holes 330, which would more easily allow the product to dry.

Still other advantages and novel features of the present invention will become apparent to those skilled in the art from the following detailed description, which simply illustrates various modes contemplated for carrying out the invention. As will be realized, the invention is capable of other different obvious aspects, all without departing from the invention. Accordingly, the drawings and descriptions are illustrative in nature and not restrictive.

What is claimed is:

1. A fluid applicator comprising:

a body having a fluid inlet, and front and rear ends;

a plurality of applicator tines extending outwardly from an application area of said body, said tines being at least partially flexible and at least some of said plurality of tines comprising a fluid pathway;

a handle portion of said body generally above said application area; and, an actuator located on said body adjacent said front end and generally above and off-center from said applicator area, said actuator operably configured to selectively dispense a predetermined amount of fluid to said fluid pathways.

2. The fluid applicator of claim 1, further comprising a fluid pump operably connected to said actuator.

3. The fluid applicator of claim 2, wherein said pump comprises a mechanical displacement pump.

4. The fluid applicator of claim 3 wherein said pump comprises a diaphragm configured to deliver a predetermined dose of fluid upon actuation.

5. The fluid applicator of claim 1, further comprising a manifold system in said body having a plurality of passageways configured to deliver substantially consistent predetermined portions of fluid to said fluid pathways of the tines.

6. The fluid applicator of claim 3, wherein said manifold system is sized and configured to provide substantially equal portions of fluid to each tine pathway.

7. The fluid applicator of claim 6, wherein the passageways of said manifold system all comprise similar cross-sectional geometries and dispense similar volumes of fluid.

8. The fluid applicator of claim 1, wherein said manifold system further comprises at least one plenum integrated within said passageways.

9. The fluid applicator of claim 1, wherein said flexible tines comprise a relatively flexible tip adjacent their distal end, and a substantially rigid base portion.

10. The fluid applicator of claim 9, wherein said tines comprise varying structural features between said base portion and said distal end which facilitate the provision of said relative flexible tip and said rigid base portion.

11. The fluid applicator of claim 10, wherein said base portion is reinforced to reduce its flexibility.

12. The fluid applicator of claim 9, wherein said flexible tip and said rigid base portion comprise different material constituents.

13. The fluid applicator of claim 1, wherein said actuator comprises a tactile indicator to signal completion of dispensing.

14. The fluid applicator of claim 13 wherein said tactile indicator comprises a positive mechanical stop.

15. The fluid applicator of claim 1, wherein said body is configured to accommodate a fluid reservoir in communication with said fluid inlet.

16. The fluid applicator of claim 15 wherein said reservoir is located at least partially within said body.

17. The fluid applicator of claim 16, wherein said reservoir is interchangeable.

18. The fluid applicator of claim 1, wherein said tines having fluid pathways for fluid dispensing are located in said application area in a predetermined dispensing pattern.

19. The fluid applicator of claim 12, wherein said dispensing pattern comprises an at least semi-circular overall configuration.

20. A fluid applicator comprising:

a body configured to accommodate a fluid reservoir, said body comprising a handle area and an application area;

a plurality of applicator tines attached to an underside of said body in said application area, and at least some of said plurality of tines comprising a fluid pathway;

a fluid source having a fluid inlet and a fluid outlet, said fluid inlet adapted to be in communication with said reservoir;

a manifold system integrally connected to said fluid outlet, said manifold system further comprising a plurality of passageways configured to deliver a substantially consistent predetermined portion of fluid to said fluid pathways; and an actuator moveably connected to the body, said actuator operably configured to selectively dispense a predetermined amount of fluid to said fluid pathways.

21. The fluid applicator of claim 20, wherein said actuator is located generally above and off-center from said application area.

22. The fluid applicator of claim 20, wherein said application area comprises less than about 80% of a total area of the underside of said body.

23. The fluid applicator of claim 22, wherein said application area comprises less than about 50% of a total area on the underside of said body.

24. The fluid applicator of claim 20, wherein said actuator comprises an area at least 10% of the size of said application area.

25. The fluid applicator of claim 20, wherein said manifold system further comprises at least one plenum integrated within said passageways.

26. The fluid applicator of claim 20, wherein said applicator dispenses between about 0.05 ml to about 0.30 ml per actuation.

27. The fluid applicator of claim 26, wherein said applicator dispenses between about 0.1 ml to about 0.2 ml per actuation.

28. The fluid applicator of claim 20, wherein the volume of fluid dispensed by each application tine does not vary by more than about 15%.

29. The fluid applicator of claim 20, wherein said plurality of tines each further comprises a flexible tip portion adjacent their distal end and a substantially rigid base portion.

30. The fluid applicator of claim 29, wherein said flexible tip portion and said rigid base portion comprise different material constituents.

31. The fluid applicator of claim 30, wherein said base portion of the tines comprises a material having a flexible modulus between about 50,000 psi to about 200,000 psi.

32. The fluid applicator of claim 30, wherein said tip portion of the tines has a durometer hardness between about 10 Shore A to about 80 Shore A.

33. The fluid applicator of claim 32, wherein said tip portion of the tines has a durometer hardness between about 35 Shore A to 50 Shore A.

34. The fluid applicator of claim 20, further comprising a protective closure configured to engage to said body.

35. The fluid applicator of claim 20, wherein said fluid source further comprises a fluid pump operably connected to said actuator.

36. A fluid applicator comprising:

a body having a fluid inlet, said body comprising a handle area and an application area;

a plurality of applicator tines extending outwardly from said application area of said body, said tines each comprising a flexible tip portion adjacent its distal end and a substantially rigid base portion, and at least some of said plurality of said tines comprising a fluid pathway; and an actuator located on said body operably configured to selectively dispense a predetermined amount of fluid to said fluid pathways.

37. The fluid applicator of claim 36, wherein said flexible tip and said rigid base portion comprise different material constituents.

38. The fluid applicator of claim 36, wherein said tines comprise varying structural features between said base portion and said distal end which facilitate the provision of said relative flexible tip and said rigid base portion.

39. The fluid applicator of claim 36, wherein said base portion of the tines comprises a material having a flexible modulus between about 50,000 psi to about 200,000 psi.

40. The fluid applicator of claim 36, wherein said tip portion of the tines has a durometer hardness between about 10 Shore A to about 80 Shore A.

41. The fluid applicator of claim 36, wherein said actuator is located generally above and off-center from said application area.

42. The fluid applicator of claim 36, further comprising a fluid pump operably connected to said actuator.

43. The fluid applicator of claim 36, further comprising a manifold system in said body having a plurality of passageways configured to deliver substantially consistent predetermined portions of fluid to said fluid pathways of the tines.

44. The fluid applicator of claim 36, wherein at least one of said tines does not include a fluid pathway.

45. The fluid applicator of claim 36, wherein said body is configured to accommodate a fluid reservoir in communication with said fluid inlet.

* * * * *